United States Patent [19]

Landry, Jr.

[11] 4,227,829

[45] Oct. 14, 1980

[54] SOIL EROSION PREVENTION BLOCKS

[76] Inventor: Kossuth J. Landry, Jr., P.O. Box 2581, Lafayette, La. 70502

[21] Appl. No.: 964,598

[22] Filed: Nov. 29, 1978

[51] Int. Cl.[2] ..... E02B 3/12; F02D 17/20

[52] U.S. Cl. ..... 405/20; 52/606; 404/35; 404/40; 404/41; 404/73; 405/258

[58] Field of Search ..... 405/16, 17, 19, 20, 405/33, 258; 52/606, 607, 676; 404/35, 37–41, 45, 73

[56] References Cited

U.S. PATENT DOCUMENTS

| | | | |
|---|---|---|---|
| 1,847,868 | 3/1932 | Everham . | |
| 2,454,292 | 11/1948 | Pickett | 405/20 |
| 2,502,757 | 4/1950 | Shearer . | |
| 3,386,252 | 6/1968 | Nelson . | |
| 3,597,928 | 8/1971 | Pilaar | 405/20 |
| 3,894,397 | 7/1975 | Fair . | |
| 3,903,702 | 9/1975 | Appleton | 405/20 |
| 3,990,247 | 11/1976 | Palmer | 405/16 |
| 3,999,398 | 12/1976 | Kurose . | |
| 4,067,196 | 1/1978 | Schraudenbach | 405/16 |

FOREIGN PATENT DOCUMENTS

| | | | |
|---|---|---|---|
| 1942406 | 8/1969 | Fed. Rep. of Germany | 405/16 |
| 2123523 | 11/1972 | Fed. Rep. of Germany | 405/20 |
| 2752545 | 11/1977 | Fed. Rep. of Germany | 404/40 |
| 659721 | 10/1951 | United Kingdom | 404/45 |

*Primary Examiner*—David H. Corbin

*Attorney, Agent, or Firm*—Guy E. Matthews

[57] ABSTRACT

The invention relates to a device for use in controlling soil erosion comprising a matrix of cellular concrete blocks, having foliage growth passageways therethrough, and held together by a series or system of cables or the like passing through internal passageways within each block. The cables are anchored into the ground to retain the blocks in position.

15 Claims, 5 Drawing Figures

SOIL EROSION PREVENTION BLOCKS

This invention relates generally to concrete blocks used for the prevention of erosion of soil along inclined areas such as highway overpass embankments. More specificly, the present invention relates to the utilization of a matrix of concrete blocks, each block having passageways or tunnels therethrough through which passes a cable or the like, which after passing through each block within the matrix system, is anchored into the ground or other supporting surface in order to retain the blocks in position to prevent the erosion of soil thereabout.

Soil erosion prevention blocks and other revetment blocks and structures are well known in the art. Of the art in this particular field, Pilaar, U.S. Pat. No. 3,597,928, is most pertinent. It discloses a matrix of soil erosion controlling blocks adhered to a porous, flexible mat positioned upon the land or surface where it is desired to control the erosion of soil. Appleton, U.S. Pat. No. 3,903,702, discloses a revetment structure comprising a system of concrete blocks having vertical passageways therethrough such that a number of blocks may be positioned adjacent one another to prevent the erosion of soil thereunder while allowing foliage, etc. to grow up through the holes or passageways within the blocks. The blocks incorporate interfitting "V" or "U" shapes to aid in retaining the blocks in position. Nelson, U.S. Pat. No. 3,386,252, discloses a rip rap structure for dams and waterways, comprising a system of rectangular blocks having a rod extending therethrough. The rods connect, hooking the blocks together to form a matrix. Similarly, Palmer, U.S. Pat. No. 3,990,247, discloses a revetment structure comprising a system of cylindrical members interconnected by a series of rods.

The problem with each of the above-mentioned devices is that the various blocks had to be prefabricated, transported to the site desired to be protected from soil erosion and installed one at a time or, in the case of U.S. Pat. No. 3,597,928, a number of blocks were preadhered to a mat leaving a sizeable mat border therearound such that a matrix of preadhered blocks, the size of which was dictated by mat strength, was positioned adjacent a similar matrix of preadhered blocks with the exposed mat borders overlapping one another to aid in retaining the various matrix sections in position.

SUMMARY OF THE INVENTION

The present invention is directed to a concrete block for use in the prevention of soil erosion, having internal passageways or tunnels through which are passed cables or the like in order to interconnect a matrix of concrete blocks in order to more easily transport and position the matrix mat of concrete blocks at the intended location. The block has basically square upper and lower surfaces, and the preferred embodiment has four side surfaces or walls dimensioned such that the height of the block is less than ½ of the length of a side.

The block contains internal passageways from side to side through which pass cables or the like that serve to interconnect a matrix of blocks to retain same in position. Also the free ends of the cables are anchored into the ground or other supporting surface to retain the concrete blocks in position. After anchoring the cables, soil and foliage may be spread over and between the blocks, thereby providing a smooth reinforced surface for controlling soil erosion.

DETAILED DESCRIPTION OF THE INVENTION

Figure 1:
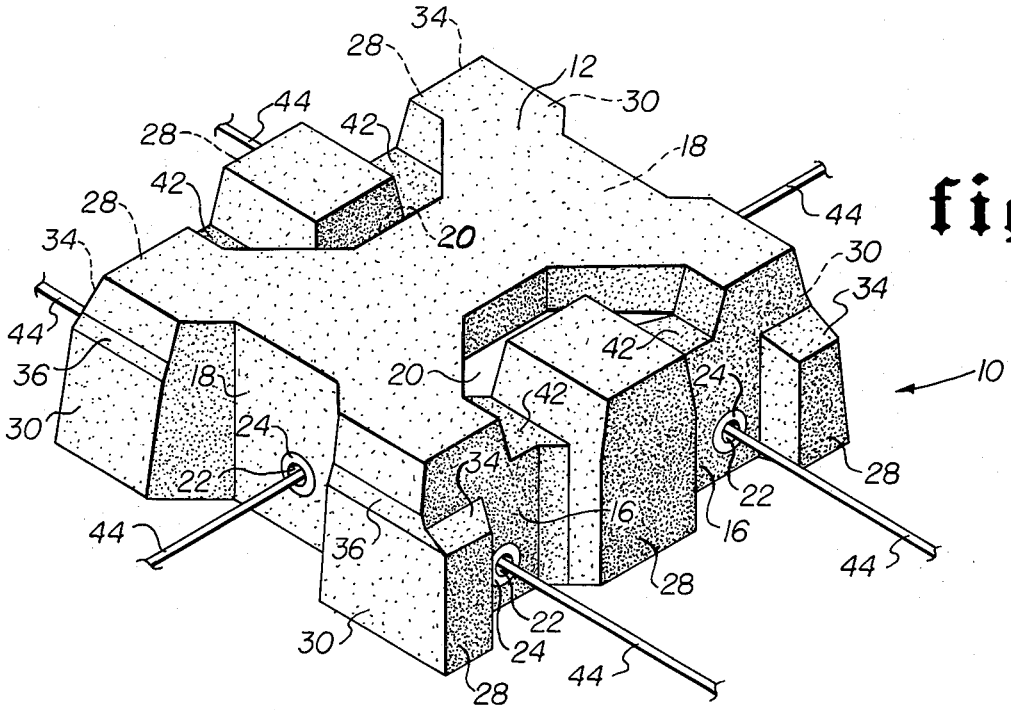
FIG. 1 is an isometric view of the soil erosion prevention block.
Figure 2:
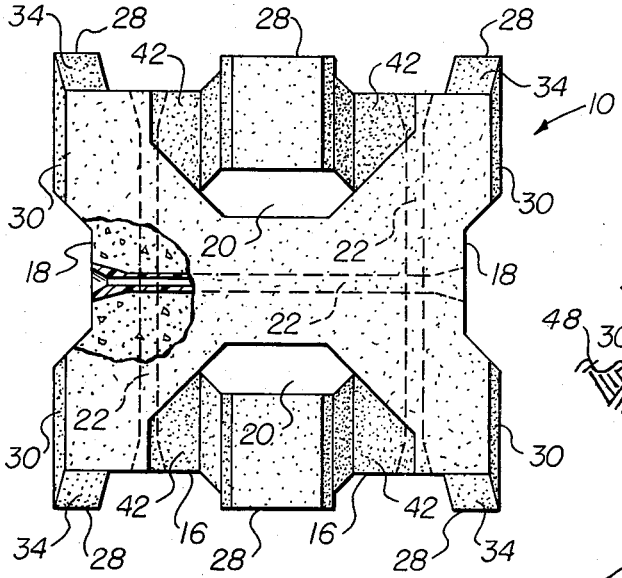
FIG. 2 is a top view of the soil erosion prevention block showing the internal cable passageways and reinforcing tunnels as dotted lines.

Referring now to the drawings, and more specifically to FIG. 1, the soil erosion prevention block is illustrated in its entirety by reference designation 10, and is shown to comprise an upper surface 12, a lower surface 14, front and rear side surfaces 16 and left and right side surfaces 18. As the drawings indicate, the side surfaces are dimensioned such that the height of the block 10 is less than ½ of the length of a side. All surfaces are substantially flat in construction, with the lower surface illustrated as being planar as opposed to the other surfaces which contain variations in contour. It is to be understood that some of the surfaces may be angled relative to the other surfaces. In the preferred embodiment, the block 10 is constructed of concrete because of its cost and availability and because of the function the block is to perform.

The block 10 includes a plurality of first internal passageways or channels 20 passing vertically through the block from the upper surface 12 to the lower surface 14 so as to permit soil to be placed therein and foliage to grow therefrom as an aid in retaining the block in position.

Figure 3:
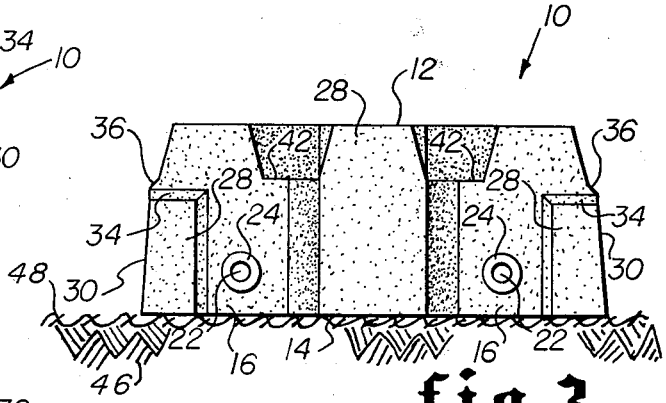
FIG. 3 is a front view of the soil erosion prevention block.
Figure 4:
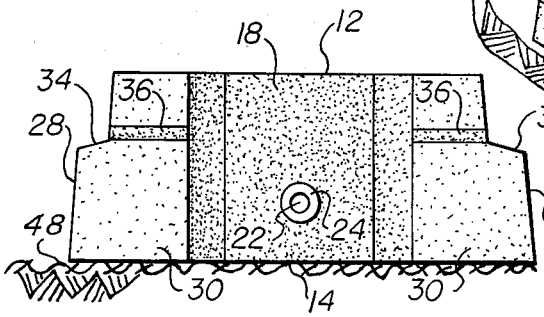
FIG. 4 is a side view of the soil erosion prevention block.

As shown in the drawings, the block 10 may include second internal passageways 22 passing through the block and interconnecting opposite side walls 16 and 18, respectively. As shown in FIGS. 3 and 4, these internal passageways 22 are essentially parallel to the lower surface 14 and are at different distances therefrom in order to avoid crossing or meeting internally within the block 10. In the preferred embodiment, the second passageways 22 include reinforcing tunnels 24 formed therewith and constructed of a material somewhat stronger than the concrete block. This material may be metal, plastic or other material that is resistant to the chemical effects of concrete. Also included are flared openings at each end of the tunnels 24 at the point where the tunnels join the side surfaces 16 and 18. This flaring aids in inserting a cable or the like into and through the internal passageways 22 when a plurality of blocks 10 are interconnected to form a matrix.

Figure 5:
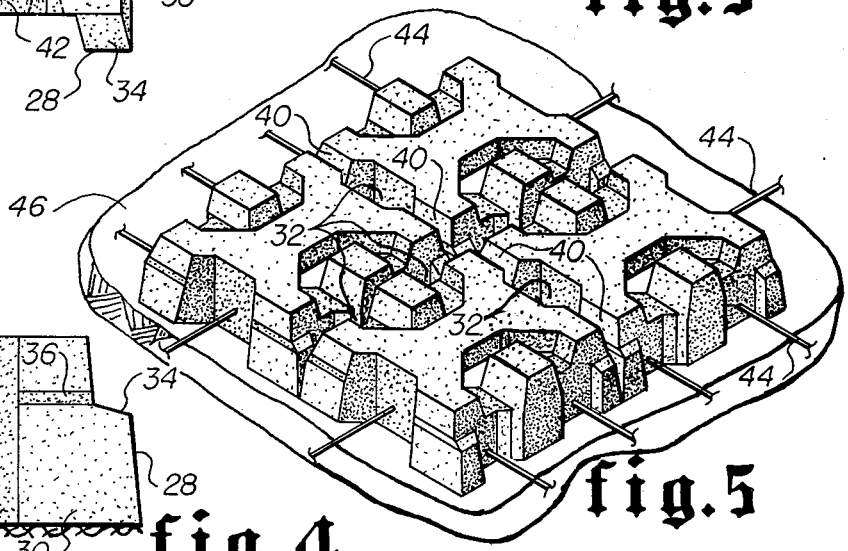
FIG. 5 is an isometric view of a number of soil erosion prevention blocks held together by cables.

The preferred embodiment includes front and rear side surface shoulders 28 and left and right side surface shoulders 30. These shoulders 28 and 30, respectively, are butted against mating shoulders of identical adjacent blocks in order to form a smooth pattern matrix of support blocks. When so positioned, the shoulders 28 and 30 on adjacent blocks form third external passageways 32 between the blocks, shown in FIG. 5, which third passageways function similar to the first internal passageways 20 by allowing the foliage to grow therethrough to aid in retaining the blocks in position.

The front and rear side surface shoulders 28 and left and right side surface shoulders 30 include front and rear shoulder tapered portions 34 and left and right shoulder tapered portions 36, respectively. When concrete blocks 10 are butted together so as to form the third external passageways 32, the shoulder tapered portions, 34 and 36 respectively, form fourth external passageways 40 between the blocks, such fourth passageways also serving to hold soil and foliage therein to aid in preventing the soil from eroding away. The block 10 also includes upper surface recesses 42 which, in the preferred embodiment, communicate with the first internal passageways 20, so as to provide added space for soil and foliage growth to prevent soil erosion.

In operation, a plurality of concrete blocks 10 are positioned with front and rear side surface shoulders 28 butting against one another so as to form a continuous line of blocks. A cable, wire, wire rope, synthetic polymer rope or the like 44 is passed through the block second internal passageways 22, and through the reinforcing tunnel 24 of each of the blocks 10. Next, the free ends of the cable or the like 44 are connected in some suitable manner to form closed loops by which the blocks may be picked up and transported about. Multiple rows of concrete blocks 10 may be laid out side by side and multiple cables 44 passed through each second internal passageway 22 and reinforcing tunnel 24 and then connected as above-mentioned. Next, cables 44 are passed through second internal passageways 22 and reinforcing tunnels 24 running crosswise or perpendicular to the passageways 22 containing cables just inserted. The free ends of these cables 44 are then connected to each other so that each cable within the system forms a closed loop. Of course, the size and number of blocks 10 within the matrix is dictated by the size and shape of the particular area to be protected from soil erosion, and the size and type of cable used is dictated by the weight and number of blocks used to form the matrix.

The particular area desired to be protected from soil erosion is graded or otherwise smoothed over to form a substantially flat, smooth surface 46, perferably with no foliage thereon. The matrix of concrete blocks 10 may then be lifted, transported to the site to be protected and positioned thereon using some form of spreader bar. As best shown in FIG. 4, front and rear side surface shoulders 28 are tapered slightly inwardly to permit a row of blocks 10 to form a slight concave pattern when the blocks are picked up by the cables 44. This feature greatly simplifies handling of the block matrix with a spreader bar.

Once transported to the site of installation, the block matrix is laid in position and the individual blocks 10 repositioned adjacent one another to form a tight matrix of blocks. The cables 44 are then disconnected from each other and may be embedded into the ground or supporting surface 46 in order to retain the block matrix in position. Obviously, not all of the cables 44 need be anchored into the ground. Some may be cut off and a cable stop affixed to the end adjacent the peripheral block in order to hold the blocks tightly together. The shoulder design of the side walls 16 and 18 creates recesses 32 between the blocks which may accomodate cable stops within the block matrix and still permit the blocks 10 to be butted against one another in a tight matrix.

Once all of the cable ends have been either anchored into the ground surface 46 or otherwise terminated adjacent the blocks themselves, dirt may be poured over the matrix and allowed to settle into the various passageways and recesses formed within the blocks and between the blocks, thereby allowing foliage to grow in and between the blocks. After the dirt has been poured over the block matrix, it is graded to form a surface even with the upper surface 12 of the block matrix. Normally some settling will occur thereafter, requiring that more dirt be added at a later time in order to sufficiently cover the upper surface of the blocks and provide sufficient soil for foliage growth.

Cables 44 passing through the various second internal passageways 22 of the block 10 have the added feature of helping to prevent erosion of the soil in that the cables within the block recesses and passageways 32 formed by the various side surfaces 28 and 30, provide another element to which grass and other foliage roots may attach themselves to aid in retaining the soil in position between the blocks and within the various block passageways and recesses.

Of course the second internal passageways 22 and reinforcing tunnels 24 may be eliminated from the soil erosion block 10 and the block or the matrix of blocks used with a suitable mat 48 of flexible filter cloth or the like positioned between the block and the surface to be protected to aid in preventing the erosion of the soil. The filter cloth mat 48 is positioned upon the preferably foliage free, graded surface so as to conform therewith and prevent soil erosion. Next, erosion prevention blocks 10 are positioned there upon and adjacent one another to form a tight matrix. Thereafter, the soil may be poured over the matrix, allowed to settle, and more soil added at a later time as set out hereinabove.

The filter cloth mat 48 permits water drainage therethrough while simultaneously providing a surface to which the roots of foliage growing between the various block matrix passageways may attach themselves to aid in retaining the soil in position between the blocks and various block passageways and recesses.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. A device for positioning upon a surface for controlling the erosion of soil therefrom, said device comprising a block having:

(a) an upper surface (b) a lower surface (c) a plurality of side surfaces, said block defining:

(1) a plurality of first passageways connecting said upper and lower surfaces for permitting soil and foliage to pass through said block to retain said block in position and prevent erosion of the soil, and (2) a plurality of second passageways connecting opposite side surfaces for permitting a cable or the like to pass through said block for retaining said block in position during transporting, installation and while said block is in position as a soil erosion controlling device each of said second passageways including a tunnel therein of reinforcing material for imparting structural reinforcement to said second passageway and to said block, and (d) at least one cable or the like passing through said second passageway, said cable being anchored at at least one end thereof into the surface below said block, once said block is in position, to retain said block in position.

2. The device as set forth in claim 1, wherein each of said second passageways is flared at its opening at respective side surfaces.

3. The device as set forth in claim 1, wherein each of said side surfaces includes a plurality of shoulders adapted to be butted against mating shoulders of identical adjacent blocks, said side surfaces of said adjacent blocks forming a plurality of third passageways between said blocks for permitting soil and foliage to pass therethrough to aid in retaining said blocks in position.

4. The device as set forth in claim 3, wherein each of said side surfaces includes the opening to at least one of said second passageways for permitting a cable or the like passing through said second passageways of adjacent blocks to pass through said third passageways formed between said adjacent blocks to aid in retaining any soil and foliage therebetween and prevent same from eroding away.

5. The device as set forth in claim 3, wherein each of said side surface shoulders includes a portion thereof that is tapered inwardly forming a fourth passageway between said blocks positioned adjacent one another for permitting soil and foliage to pass therethrough to aid in preventing same from eroding away.

6. The device as set forth in claim 1, wherein said upper surface includes a plurality of recesses therein for permitting soil and foliage to grow therein to aid in retaining said block in position and prevent the soil and foliage therein from eroding away.

7. The device as set forth in claim 1, including a flexible filter cloth mat positioned under said block and upon the surface to be protected from soil erosion, said cloth mat adapted to conform to the contour of the surface to aid in preventing soil erosion.

8. A system comprising a matrix of soil erosion prevention blocks positioned upon a surface for controlling the erosion of soil therefrom, each of said blocks having:

(a) an upper surface, (b) a lower surface, (c) a plurality of side surfaces, said block defining:

(1) a plurality of first passageways connecting said upper and said lower surfaces for permitting soil and foliage to pass through said block to retain said block in position and prevent erosion of the soil, and (2) a plurality of second passageways connecting opposite side surfaces for permitting a cable or the like to pass through adjacent blocks within said matrix system, each of said block second passageways including a tunnel therein of reinforcing material for imparting structural reinforcement to said second passageway and to said block, and (d) a plurality of cables or the like passing through said block second passageways for retaining said block matrix in position during transporting and installation thereof and for anchoring said matrix to the ground to retain said matrix in position to prevent erosion of the soil, wherein a plurality of said blocks are positioned adjacent one another to form said block matrix, and wherein said plurality of cables or the like extend through said block second passageways and into the ground for anchoring said block matrix thereto.

9. The device as set forth in claim 8, wherein each of said block second passageways is flared at its opening at respective block side surfaces.

10. The device as set forth in claim 8, wherein each of said block side surfaces includes a plurality of shoulders adapted to be butted against mating shoulders of identical adjacent blocks, said side surfaces of said adjacent blocks forming a plurality of third passageways between said blocks for permitting soil and foliage to pass therethrough to aid in retaining said blocks in position.

11. The device as set forth in claim 10, wherein each of said block side surfaces includes the opening to at least one of said second passageways for permitting a cable or the like passing through said third passageways formed between said adjacent blocks to aid in retaining any soil and foliage therebetween and prevent same from eroding away.

12. The device as set forth in claim 10, wherein each of said block side surface shoulders includes a portion thereof that is tapered inwardly forming a fourth passageway between said blocks positioned adjacent one another for permitting soil and foliage to pass therethrough to aid in preventing same from eroding away.

13. The device as set forth in claim 8, including a flexible filter cloth mat positioned under said block matrix and upon the surface to be protected from soil erosion, said cloth mat adapted to conform to the contour of the surface to aid in preventing soil erosion.

14. The device as set forth in claim 8, wherein said block upper surface includes a plurality of recesses therein for permitting soil and foliage to grow therein to aid in retaining said block in position and prevent the soil and foliage therein from eroding away.

15. A method of preventing soil erosion on a surface comprising (a) grading the area to be protected from erosion to form an essentially smooth surface, (b) providing a plurality of soil erosion preventing blocks each including a plurality of internal passageways through which a plurality of cables or the like may pass so as to interconnect said blocks, (c) positioning a plurality of said soil erosion blocks together to form a matrix of appropriate size in such a manner that said internal passageways are aligned one with another, (d) passing a plurality of cables or the like through said block internal passageways and connecting the free ends of each of said cables together, (e) lifting said block matrix by said cables and transporting said matrix to the previously graded smooth surface, (f) placing said block matrix in position using said cables and positioning said blocks adjacent one another to form a tight matrix of soil erosion prevention blocks, (g) disconnecting said cables from each other and anchoring at least one end thereof into the surface to be protected, (h) covering said block matrix with soil and foliage in order that the soil and foliage may settle into recesses and passageways within said matrix, and (i) smoothing over the upper surface of the matrix to form a smooth, supported, soil erosion prevention surface.

* * * * *